US006082108A

United States Patent [19]

Scheidl et al.

[11] Patent Number: 6,082,108

[45] Date of Patent: Jul. 4, 2000

[54] HYDROSTATIC DRIVE CONTROL DEVICE

[75] Inventors: Rudolf Scheidl, Erlauf; Gerald Riha, Linz-Leonding; Michael Garstenauer, Steyr; Siegfried Grammer, Linz, all of Austria

[73] Assignee: Mannesmann Rexroth AG, Lohr/Main, Germany

[21] Appl. No.: 09/043,260

[22] PCT Filed: Sep. 10, 1996

[86] PCT No.: PCT/EP96/03964

§ 371 Date: Mar. 11, 1998

§ 102(e) Date: Mar. 11, 1998

[87] PCT Pub. No.: WO97/10444

PCT Pub. Date: Mar. 20, 1997

[30] Foreign Application Priority Data

Sep. 12, 1995 [AT] Austria ..... 1509/95

[51] Int. Cl.[7] ..... F15B 21/12

[52] U.S. Cl. ..... 60/532; 60/416

[58] Field of Search ..... 60/532, 413, 416, 60/910; 91/5

[56] References Cited

U.S. PATENT DOCUMENTS

| | | | |
|---|---|---|---|
| 3,046,951 | 7/1962 | Freeborn . | |
| 3,228,301 | 1/1966 | Bolie | 91/5 |
| 5,540,052 | 7/1996 | Sieke et al. . | |
| 5,974,800 | 11/1999 | Scheidl et al. | 60/532 |

FOREIGN PATENT DOCUMENTS

| | | |
|---|---|---|
| 0635601 | 1/1995 | European Pat. Off. . |
| 2414043 | 10/1975 | Germany . |
| 2516154 | 10/1976 | Germany . |
| 9623980 | 8/1996 | WIPO . |

OTHER PUBLICATIONS

Energie Fluide vol. 14, No. 83 Dec. 1975, Paris FR. pp. 28–32, XP002008512 "le generateur hydraulique d'impulsions au service du formage des metaux."

*Primary Examiner*—F. Daniel Lopez
*Attorney, Agent, or Firm*—Martin A. Farber

[57] ABSTRACT

A device for controlling a hydrostatic drive (1) having a resonator (2) which is connected on the one hand to the hydrostatic drive (1) and on the other hand to a pressurized-fluid supply line (4) and to a return line (5), and having a periodically actuatable switch valve (3) which connects the resonator (2) alternately with the pressurized-fluid supply line (4) and the return line (5). In order to assure advantageous control conditions, the resonator (2) has at least one pressure chamber (6) with a movable, oscillatable chamber limitation (7) for changing the chamber volume movable chamber limitation (7) form a part of a single-mass oscillator comprising mass and spring (10). The pressure chamber (6) which can be connected alternately with the pressurized-fluid supply line (4), the return line (5) and the hydrostatic drive (1) can be acted on via the switch valve (3) with a switch frequency which lies in the supraresonance region of the single-mass oscillator.

16 Claims, 7 Drawing Sheets

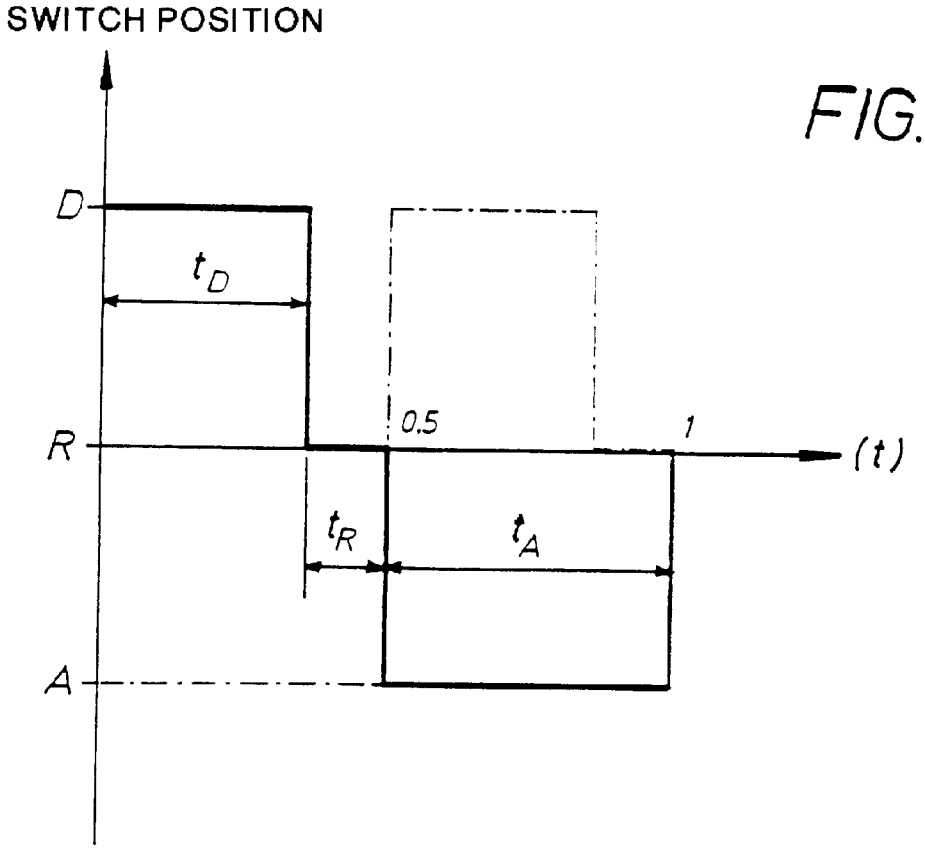
FIG. 2
FIG. 6
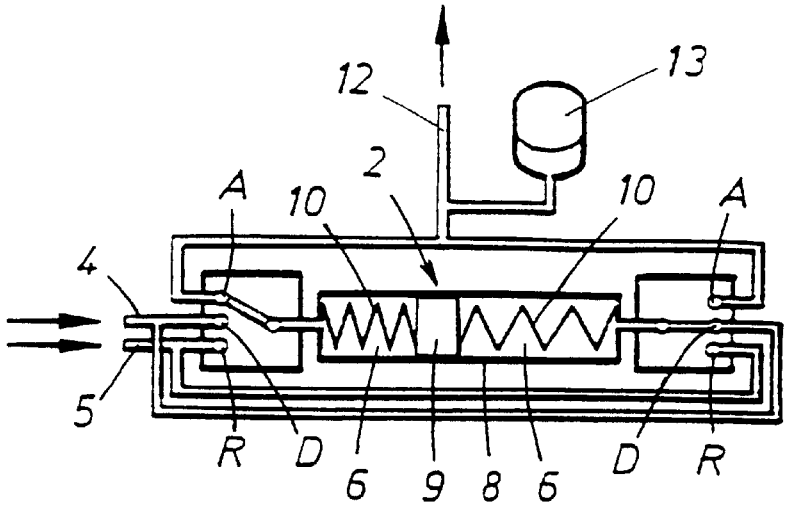

IX
X
XI
10
19
18
9
6
20
29
25
24
4
30
21
28
12
26
22
23
5
27
17
6
10
19
9
10
XI
X
IX

HYDROSTATIC DRIVE CONTROL DEVICE

FIELD AND BACKGROUND OF THE INVENTION

The present invention refers to a device for controlling a hydrostatic drive having a resonator which is connected on the one hand to the hydrostatic drive and, on the other hand, to a pressurized-fluid supply line and a return line, and having a periodically actuatable switch valve which connects the resonator alternately with the pressurized-fluid supply line and the return line.

In order to avoid, in particular, the throttle losses of throttle-controlled hydrostatic drives, it is known not to connect the drive continuously via a throttle valve but rather periodically to a hydraulic-fluid supply line or a return line over switch valves each connected in parallel with a non-return valve. The opening of the switch valve in the hydraulic-fluid supply line results in an accelerating of the drive, the inertia of which upon the closing of this switch valve leads to a reduction in the pressure of the compressible hydraulic fluid in the drive region to a pressure which is less than the closure pressure of the non-return valve in the region of the return line so that, via the return line, hydraulic fluid can be drawn in until the switch valve in the supply line again opens and the process is repeated. In the event of a useful braking of the drive there results, upon the closing of the switch valve in the return line, an increase in the pressure of the drive-side hydraulic fluid to an amount exceeding the closing pressure of the non-return valve in the region of the supply line, which brings about a pumping of the hydraulic fluid back into the supply line. This additional flow of hydraulic fluid made possible by the pulsating control of the drive brings about a corresponding recovery of energy and thus an improved efficiency which, to be sure, is purchased at the cost of a comparatively slight dynamism and a corresponding structural expense.

In order to adjust the operating pressure for the hydrostatic drive independently of its operating path between the maximum pressure offered by the hydraulic-fluid supply line and the pressure of the return line, it has already been suggested that the hydrostatic drive be connected to a resonance tube which is connected alternately via a periodically actuatable switch valve to a pressurized-fluid supply line and a return line in order to produce standing pressure waves of the hydraulic fluid in the resonance tube under conditions of resonance. By the provision of a pressure outlet in an oscillation node of the resulting standing pressure waves in the resonance tube, it is possible to provide at this pressure outlet an operating pressure for the drive via the operating path of the drive. Furthermore, the pressure waves of the arrangements associated with this node at the pressure outlet are suppressed so that, despite a pulsating control, the pulsation in time of the operating pressure at the pressure outlet is comparatively slight. Since the length of the resonance tube must be selected as a function of the length of the pressure waves formed in the hydraulic fluid, corresponding tube lengths are to be expected which may limit the possible use of these devices. Furthermore, due to the pressure adjustment, such a device is advisable for the adjustment of the pressure, in particular for the acceleration control.

SUMMARY OR THE INVENTION

The object of the invention is therefore so to develop a device for controlling hydrostatic drives of the type described above that the use of a resonance tube is unnecessary and speeds can preferably be controlled.

According to the invention achieves the task in view in the manner the resonator has at least one pressure chamber having a movable, oscillatable chamber delimitation for changing the volume of the chamber, the movable chamber limitation forms a part of a single-mass oscillator comprising of mass and spring, and the pressure chamber which can be connected alternately with the pressurized-fluid supply line, the return line and the hydrostatic drive can be acted on via the switch valve with a switch frequency which lies within the supraresonance region of the single-mass oscillator.

By the pressure chamber of variable volume in combination with the single-mass oscillator, the result is obtained that the pressurized fluid which flows during the connection of the pressure chamber on the one hand with the pressurized-fluid supply line and, on the other hand, with the return line into the pressure chamber, during the connection of the pressure chamber with the hydrostatic drive is forced again out of the pressure chamber, as a result of the energy stored in the spring of the single-mass oscillator, so that a volumetric flow of the hydraulic pressurized fluid which is dependent on the switch frequency of the switch valve is established, which therefore also can be controlled in advantageous manner via the switch frequency of the switch valve. For this purpose, to be sure, there can only be meaningfully used switch frequencies in the supraresonance region of the single-mass oscillator and therefore in a frequency range above its resonance frequency. Due to the simple possibility of influencing the volumetric flow, the device is in particular suitable for speed control.

Since the volumetric flow of the hydraulic pressurized fluid for the hydrostatic drive also depends on the open time of the switch valve for the connection of the pressure chamber with the pressurized-fluid supply line, this open time can be set for the control of the volumetric flow. Use is made of this possibility in particular when, with comparatively small volumetric flows, the switch frequency can no longer be increased due to the existing structural conditions. The efficiency of the control device of the invention depends on the friction occurring in the region of the single-mass oscillator, the liquid friction and the pressure losses in the region of the switch valve and can be influenced by the open time of the switch valve, particularly when the volumetric flow is controlled via the switch frequency. It has been found that for a favorable efficiency, the open time of the switch valve for the pressurized-fluid supply line must be changed proportionately to the pressure in the connecting line of the drive.

Another possibility of adjustment results from the selection of the open times for the connecting line of the hydrostatic drive. If, namely, the connected time of the drive to the pressure chamber is correspondingly shortened as compared with the connected time to the pressurized-fluid supply line and to the return line, then a hydraulic average pressure which exceeds the pressure in the pressurized-fluid supply line can be made available for the drive. Upon an increase of the connected times of the drive for the connection to the pressure chamber, the volumetric flow can, on the other hand, be decreased, with the advantage that the efficiency is not impaired, contrary to a volumetric-flow control via the open time of the pressurized-fluid supply line.

If the volumetric-flow variations or the pressure variations are to be reduced on the connection side of the hydrostatic drive, then the connecting line between the pressure chamber and the hydrostatic drive can be connected with a pressure storage which sees to a corresponding compensation of the pressure variations.

The pressure chamber can be developed in various ways since the only important thing essentially is an oscillatable chamber limitation which changes the chamber volume. For this purpose, the pressure chamber of the resonator can consist of a cylinder the piston of which which produces the movable chamber limitation forms the single-mass oscillator with at least one spring acting on the piston. This cylinder may be acted on only from one side by the hydraulic pressurized fluid. Particularly advantageous conditions result to be sure when the resonator is developed as a cylinder which can be acted on on both sides, its two pressure chambers being connected with respect to their switch periods by switch valves which are 180° out of phase, each individually to a pressurized-fluid supply line one the one side and the return line as well as, on the other hand, to a hydrostatic drive, since in this case the action on the piston on the one side can be used for the ejection of pressurized fluid on the other side. In this connection, the connecting lines for the hydrostatic drive on the two sides of the cylinder need not be necessarily connected to a common hydrostatic drive.

Another embodiment for the pressure chamber of the resonator is obtained if the movable chamber limitation of the pressure chamber consists of a bellows or a membrane. In combination with a spring-loaded mass, a simple single-mass oscillator can also be prepared for such a pressure chamber, in which case similar manners of action are established.

The producing of dependable switch connections between the pressure chamber on the one side and the hydrostatic drive as well as the pressurized-fluid supply line or the return line on the other hand in the required switch frequency represents an essential condition for the practical use of a control device in accordance with the invention. In order to satisfy such structural requirements, the switch valve can be developed as rotary piston valve with a rotary piston, which alternately connects the pressure chamber or pressure chambers via control ports with connecting chambers which are connected to the pressurized-fluid supply line, the return line or the connecting line for the hydrostatic drive. During a revolution of the piston, the connections of the corresponding pressure chambers are connected one after the other to the corresponding lines, in which connection the control ports assure a rapid opening and closing of these connections. The provision of a rotary piston offers in addition to this the advantage of being able to arrange several pressure chambers distributed uniformly over the circumference. The pressure chambers can in this connection be controlled axially as well as radially, in the same way as the axes of oscillation of the single-mass oscillators of the pressure chambers can extend radially or paraxially to the piston of rotation. Radial axes of oscillation of the single-mass oscillators to be sure permit a complete equalization of mass in the event of a corresponding arrangement. Paraxial axes of oscillation to be sure offer structural advantages for resonators which can be acted on on the sides.

In order to control the switch times of a rotary piston valve the switching frequency of which depends on the speed of rotation of the piston, there can be arranged, coaxial to the rotary piston, control bodies which are rotatably displaceable with respect to the pressure chamber or the pressure chambers which are arranged with rotational symmetry with respect to the rotary piston, preferably in the form of control disks or sleeves, which control bodies form control edges which cooperate with the control ports of the rotary piston. By these control edges, the control ports of the rotary piston are released or closed so that the switch times of the switch valve can be adjusted via the rotational position of the control bodies forming the control edges. Control disks cooperate in this connection via radially aligned control edges with end control ports of the rotary piston while the control sleeves have axially directed control edges for control ports provided in the piston wall. By a suitable combination of such control disks or sleeves, the individual switch times of the switch valves can accordingly be adjusted in accordance with the specific requirements.

BRIEF DESCRIPTION OF THE DRAWINGS

With the above and other objects and advantages in view, the present invention will become more clearly understood in connection with the detailed description of preferred embodiments, when considered with the accompanying drawings of which

FIG. 2 shows a time diagram of the switch positions of a switch valve in a coordinate system on the ordinates of which the three switch positions are plotted and on the abscissae of which the switch times referred to the duration of the period are plotted;

FIG. 6 is a block diagram of a device in accordance with the invention which is amplified as compared with FIG. 1;

DETAILED DESCRIPTION OF THE PREFERRED EMBODIMENTS

Figure 1:
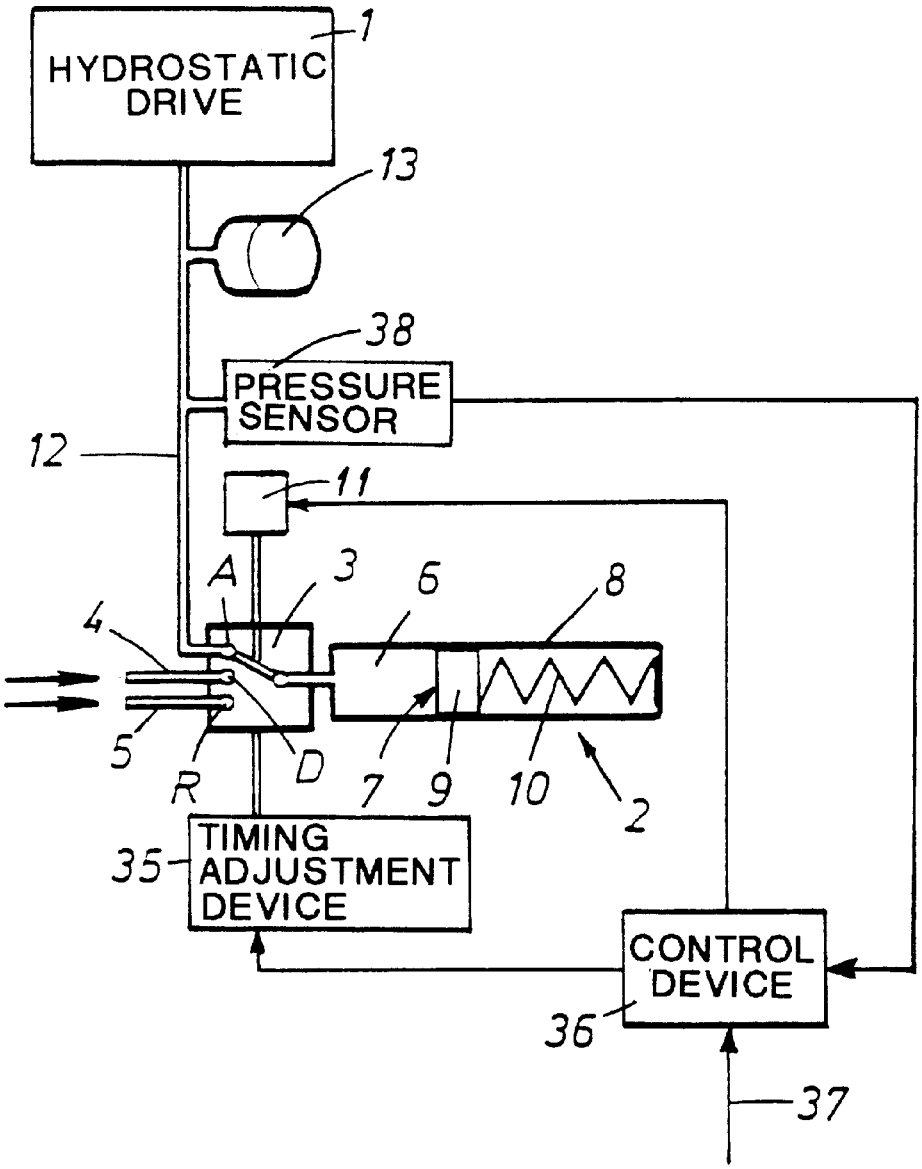
FIG. 1 shows a device in accordance with the invention for controlling a hydrostatic drive in the form of a simple block diagram.
Figure 3:
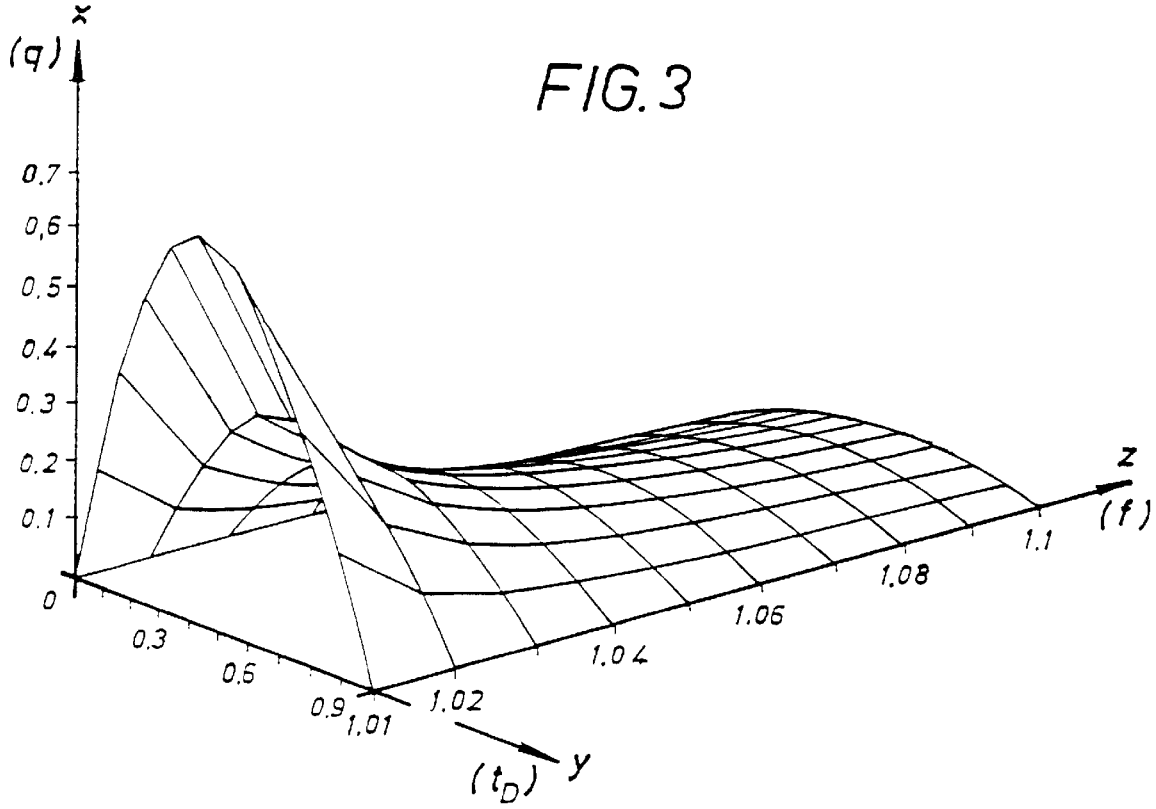
FIG. 3 shows the dependence of the average volumetric flow through the resonator, referred to a rated flow, on the switch frequency of the switch valve referred to the resonance frequency and of the open time, referred to the pressurized-fluid supply line referred to the switch period in a three-dimensional coordinate system.

The device for controlling the hydrostatic drive 1 of, for instance, a working cylinder, has, in accordance with FIG. 1, a resonator 2 which is connected alternately by means of a periodically actuatable switch valve 3 with a pressurized-fluid supply line 4, with a return line 5 to a possibly prestressed hydraulic-fluid tank and with the hydrostatic drive. The resonator 2 is formed by a pressure chamber 6 having a movable, swingable chamber limitation 7, namely by a cylinder 8 the piston 9 of which is active with a spring 10 as single-mass oscillator, when the piston 9 is acted on in the resonance region of the single-mass oscillator via the switch valve 3 which is connected with a suitable drive 11. The hydraulic fluid which is conveyed during the switch connection with the pressurized-fluid supply line 4 or the return line 5 into the pressure chamber 6 is fed during the resonator connection with the hydrostatic drive 1, due to the energy stored in the single-mass oscillator upon the hydraulic piston action via the connection line 12 to the hydrostatic drive 1, in which connection in order to dampen the pressure pulses a pressure accumulator 13 can be provided. Such a switch cycle is shown in FIG. 2. During the time $t_D$, the switch valve 3 (switch position D) connects the resonator 2 with the pressurized-fluid supply line 4 in order then to establish the connection with the return line 5 in the switch position R, namely in the time $t_R$ in which, as a result of the inertia of the single-mass oscillator, hydraulic fluid is drawn from the return line 5 into the pressure chamber 6. In the next switch position A, the hydraulic fluid, during the time $t_A$ which corresponds to half the period in FIG. 2, is forced via the piston 9 by the spring 10 into the connecting line 12. The volumetric flow through the resonator 2 is thus dependent on the switch frequency f of the switch valve 3 and the relative open time $T_D$ of the pressurized-fluid supply line 4 within a switch period. If the losses which have occurred are disregarded, a dependence shown in FIG. 3 then results between the average volumetric flow q referred to a rate of flow to the pressurized-fluid supply line 4, the switch frequency f referred to the resonance frequency of the resonator, and the relative open time $t_D$ of the pressurized-fluid supply line 4, in which connection only the frequency range over the resonance frequency of the resonator 2 can be meaningfully utilized. From FIG. 3, which shows a three-dimensional coordinate system with the axes x for the relative average volumetric flow q, y for the relative open time $t_D$, and z for the relative switch frequency f, it can be noted that a change in the switch frequency can be utilized in order to control the volumetric flow q in the region of larger volumetric flows. Only with small volumetric flows, for which excessively high switch frequencies result, should the open time $t_D$ be used as setting value for the control of the volumetric flow q. Upon control of the volumetric flow via the switch frequency f, the open time $t_D$ can be set for an optimizing of the efficiency which is to be taken into account after all in view of the unavoidable friction and pressure losses. The open time $t_D$ is for this purpose to be selected proportional to the pressure available for the drive 1.

Figure 4:
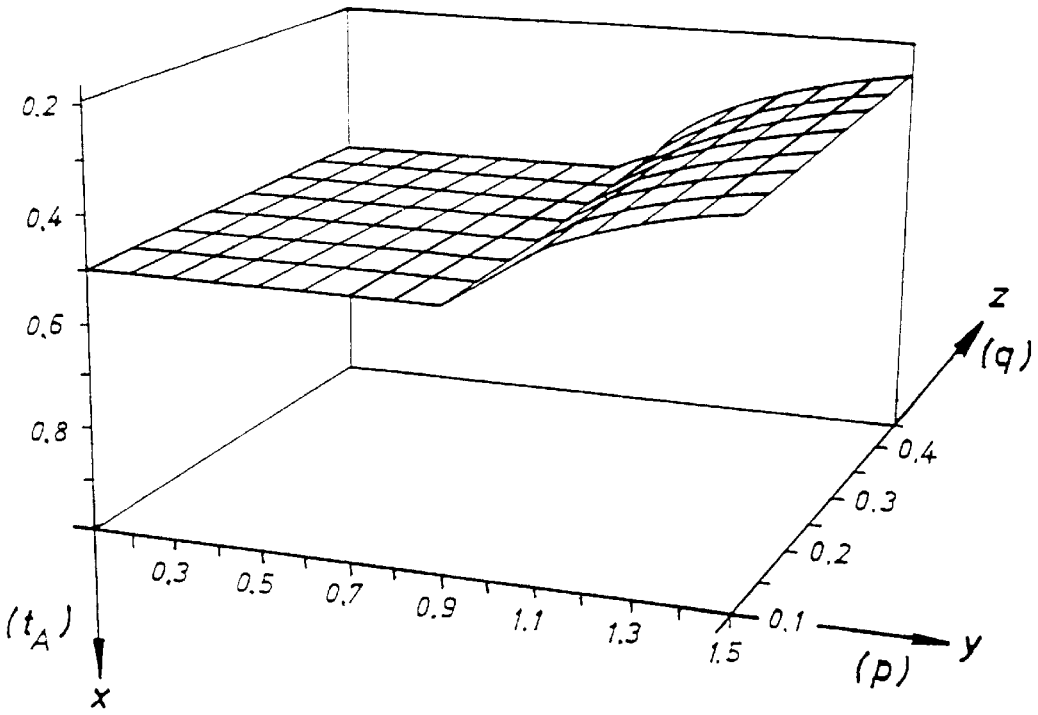
FIGS. 4 and 5 show the mutual dependence of the average volumetric flow through the resonator of the open time, referred to the switch period, of the connection for the hydrostatic drive and of the pressure in the connecting line, referred to the pressure in the supply line, for the hydrostatic drive, in a three-dimensional coordinate system.
Figure 5:
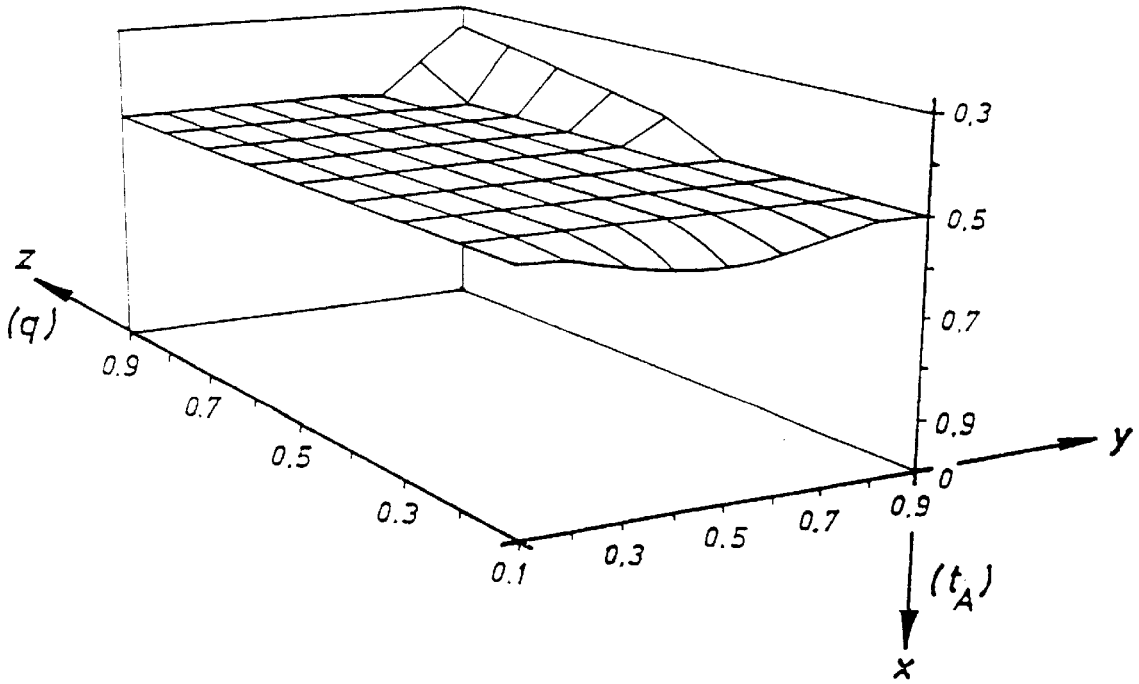
Figure 8:
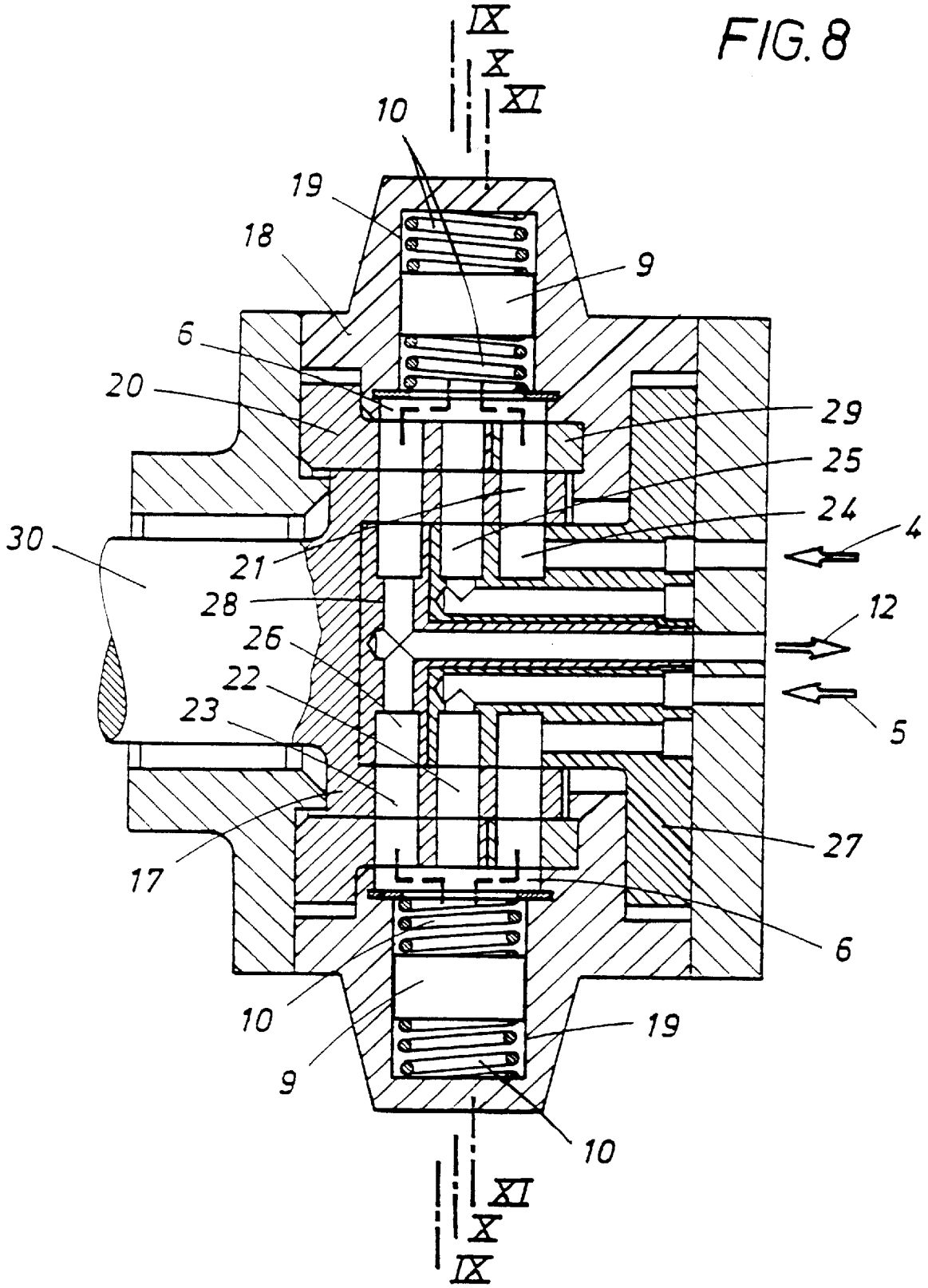
FIG. 8 shows a simplified axial section through a switch valve.

Of course, the open time $t_A$ for the connecting line 12 need not correspond to half the period. If an open time $t_A$ which is less than half the period is selected, then a pressure exceeding the pressure in the pressurized-fluid supply line 4 can be made ready for the drive 1. With longer open times $t_A$, on the other hand, the volumetric flow can be lowered without a loss in efficiency. FIGS. 4 and 5 show in each case the relationships determined for optimal efficiency between the relative open time $t_A$, the pressure p at the connection A referred to the constant pressure in the pressurized-fluid supply line, and the relative volumetric flow q, on the one hand, for open times $t_A$ less than and on the other hand greater than half a period, in which connection in each case the open times $t_A$ are plotted on the x axis of a three-dimensional coordinate system, the relative pressure p on the y axis and the volumetric flow q referred to a rated flow on the z axis. The losses which occur were taken into account in this connection by a relative damping factor of 5%. It can be noted from FIG. 4 that with shorter open times $t_A$, the relative pressure p can be considerably increased. Upon a lengthening of the open times $t_A$ to more than half the period, the volumetric flow q can again be controlled within the region of small amounts in accordance with FIG. 5.

It need not be particularly emphasized that, in contradistinction to the working operation shown in the drawing, in braking operation the volumetric flow flows from drive 1 to the return line 5 or the pressurized-fluid supply line 4, which leads to a change in the switch sequence and the switch times. The fundamental control conditions, however, remain the same.

As can be noted from FIG. 6, two pressure chambers 6 which can be acted on in shifted phase are provided, in which connection preferably the mass of the single-mass oscillator determined by the piston 9 which is provided between these pressure chambers 8 has springs 10 on both actuation sides. With such a construction, a switch valve 3 is of course to be provided for both pressure chambers 6, which see to it that the switch periods of the two switch valves are shifted in phase 180° from each other. In FIG. 2, the switch positions and times of the second switch valve which is driven with the same frequency but shifted in phase are indicated in dash-dot line.

The connections A of the two switch valves 3 are connected in accordance with FIG. 6 with a common connecting line 12 for a hydrostatic drive, which, however, is not urgently necessary since separate drives can also be controlled via a common resonator.

Figure 7:
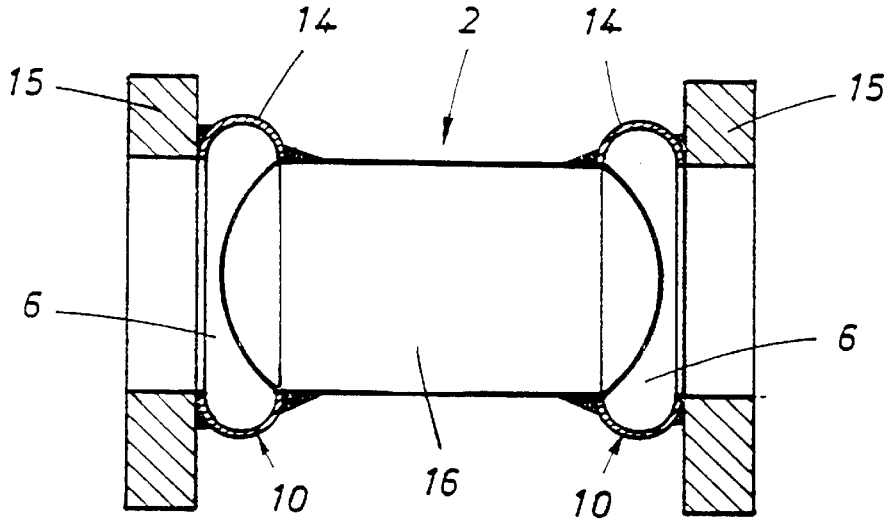
FIG. 7 shows a further embodiment of a resonator in a simplified axial section.

The mass of the single-mass oscillator need not be formed by the piston 9 of a cylinder, as is shown in FIG. 7, in which the pressure chambers 6 are delimited by membranes 14 which connect the connecting flanges 15 corresponding switch valves in liquid-tight manner with the oscillator mass and at the same time form the springs 10 of the single-mass oscillator.

Figure 9:
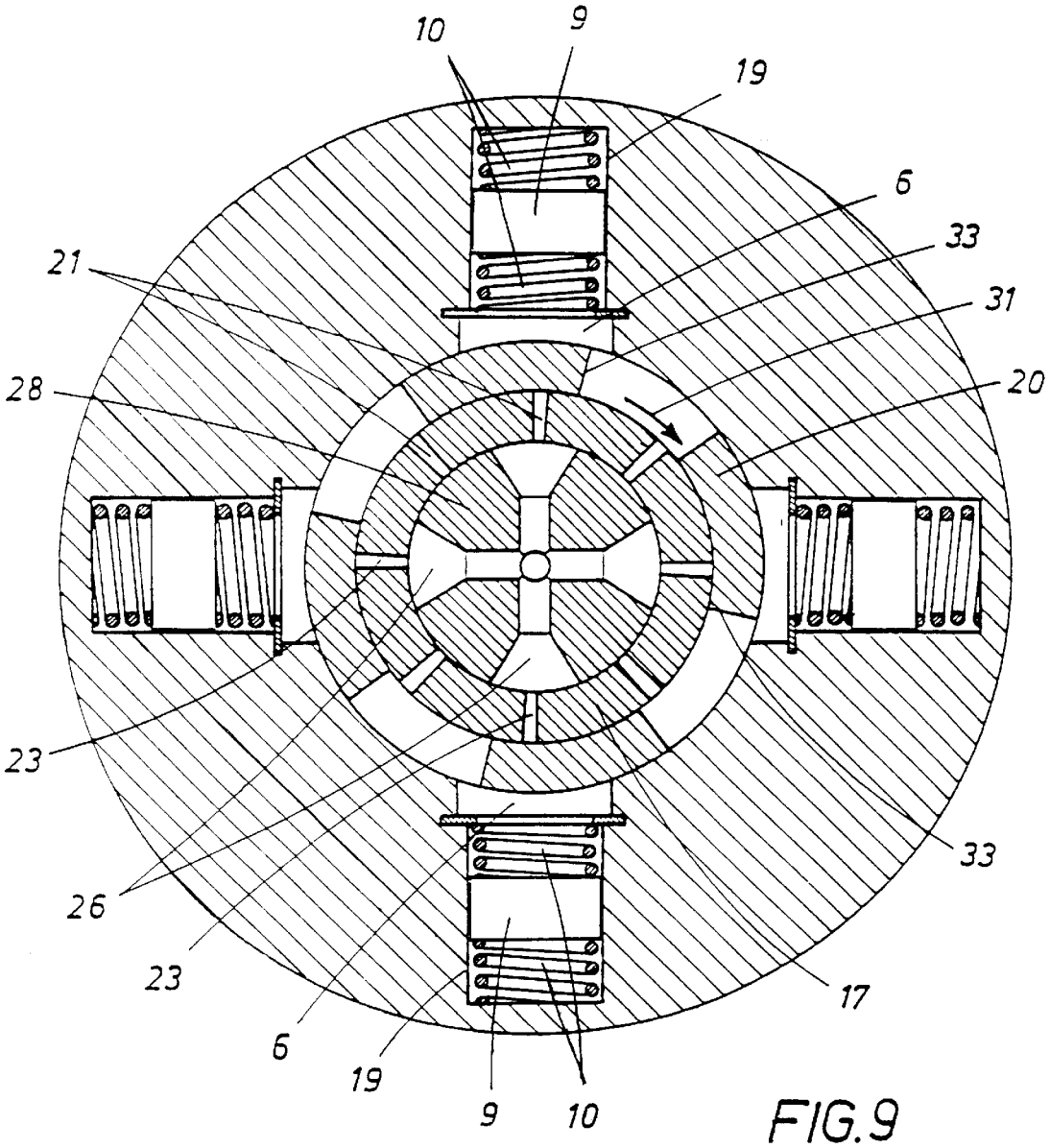
FIG. 9 is a section along the line IX—IX of FIG. 8.
Figure 10:
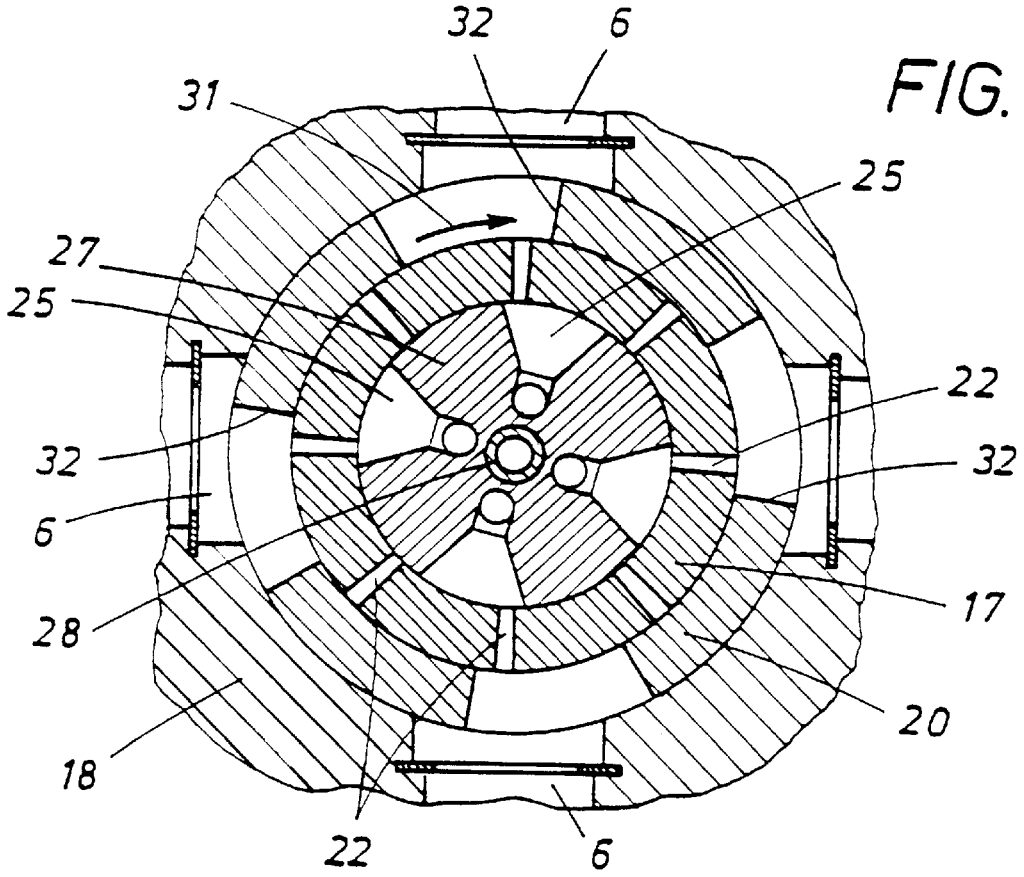
FIG. 10 is a section along the line X—X of FIG. 8.
Figure 11:
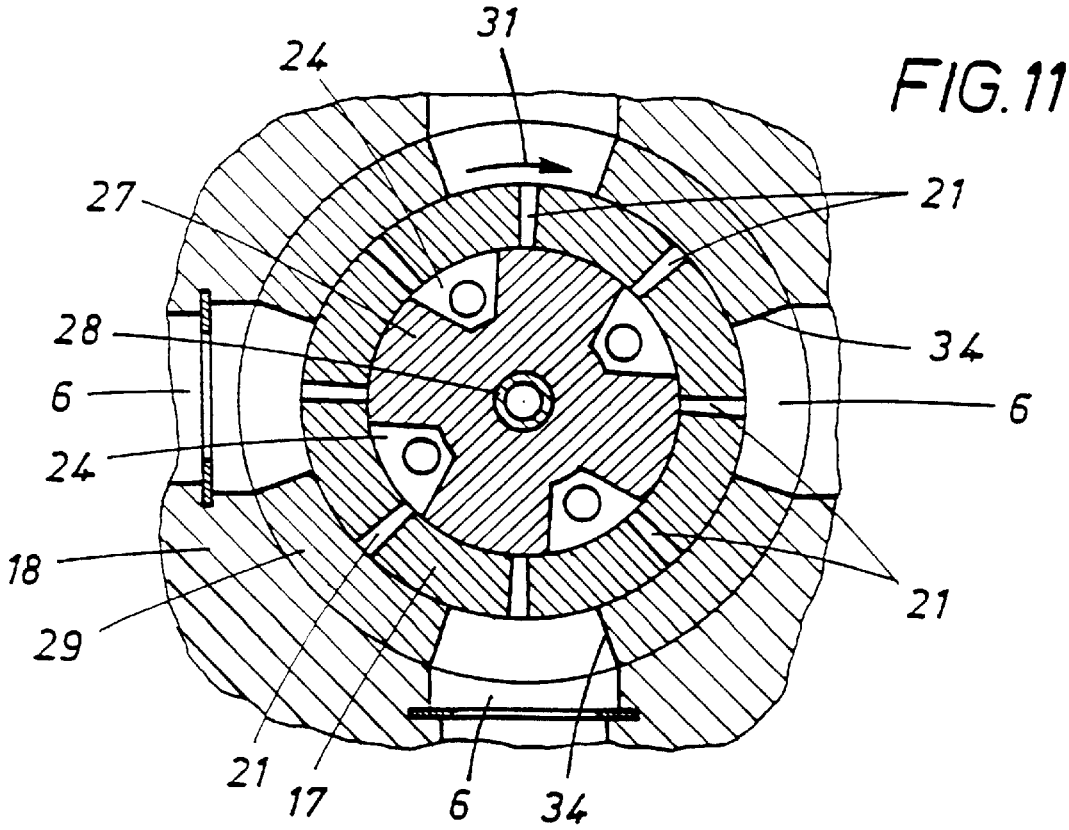
FIG. 11 is a section along the line XI—XI of FIG. 8.

In order to be able to utilize the advantages of a resonator 2 in accordance with the invention in order to control hydrostatic drives, suitable switch valves 3 for the required switch frequencies must be available. A device which satisfies these requirements and combines several resonators with the corresponding switch valves is shown diagrammatically in FIGS. 8 to 11. It consists essentially of a housing 18 containing a rotary piston 17 in which housing there are mounted opposite each other, in pairs, cylindrical holes 19 directed radially to the rotary piston 17 having pistons 9 acted on by springs 10 which represent single-mass oscillators in accordance with FIG. 1. The pressure chambers 6 resulting on the inside of the pistons 9 are connected via a control sleeve 20 surrounding the rotary piston 17 to the rotary piston 17 which has control ports 21, 22 and 23, by means of which the pressure chambers 6 can be alternately connected with connecting chambers 24, 25 and 26 divided up in accordance with the arrangement of resonators for the pressurized-fluid supply line 4, the return line 5, and the connecting line 12. The connecting chambers 24, 25 associated with the pressurized-fluid supply line 4 and the return line 5 are provided in a control body 27 which is mounted rotatably displaceable within the hollow rotary piston 17. The connecting chambers 25 associated with the connecting line 12 are, however, formed by an insert 28 which is fastened in the housing and which passes coaxially through the control body 27. In FIGS. 9 to 11, the switch position R is shown in which the pressure chambers 6 are connected with the return line 5. In accordance with FIG. 10, this switch connection is obtained via the control ports 22 of the rotary piston 17 which are located in the region of the connecting chambers 25 for the return line 5. The control ports 21 for the switch connection D which are present in the region of the connecting chambers 24 for the pressurized-fluid supply line 4 are covered, in accordance with FIG. 11, by a control ring 29 which is fastened to the housing while the switch connection A, in accordance with FIG. 9, is interrupted by the control sleeve 20. If the rotary piston 17 which is driven via a shaft 30 turns continuously in the direction of rotation of the arrow 31, then the switch connection R via the control ports 22 is interrupted by the control edges 32 of the control sleeve 20, which at the same time opens the switch connection A via the control ports 22 when the control ports 23 reach the control edges 33 of the control sleeve 20 which are shifted accordingly with respect to the control edges 32 (FIG. 9). As can be noted from FIG. 11, the control ports 21 are still covered by the control sleeve 20 as long as the switch connection A is maintained. This switch connection A is only interrupted when the control ports 23 come out of the region of the connecting chambers 26. In this position of rotation of the rotary piston, the switch connection D is released by the control edges 34 in accordance with FIG. 11, until the control ports 21 leave the region of the corresponding connecting chambers 24, whereupon the switch cycle described is repeated.

In order to be able to adjust the switch times $t_D$, $t_R$ and $t_A$, the control sleeve 20 and the control body 27 are displaceable rotatably, namely via drives which have not been shown in the drawing in order not to clutter it. As can be noted from FIG. 9, the open time $t_A$ for the switch connection A is determined by the position of rotation of the control sleeve 20. The division of the switch times $t_D$ and $t_R$ over the remaining period results from the rotary position of the control body 27 with respect to the control sleeve 20.

In order that the control most favorable for the specific case of use can be realized, it is advisable to provide a control such as indicated in a block diagram in FIG. 1. The drive 11 for the switch valve 3 as well as a setting device 35 for the control sleeve 20 and the control body 27 are controlled via a closed-loop control device 36 which controls the switch frequency f, the open time $r_D$ for the switch connection D and possibly the open time $t_A$ for the switch connection A, for example in accordance with families of characteristics introduced, which take into account the efficiency on the one hand mutual dependence of the volumetric flow and, the pressure available for the hydrostatic drive 1 on the other hand. On basis of the desired values entered via the input 37 for the volumetric flow and the mean hydraulic pressure detected in the pressure line 12 by a pressure indicator 38, the switch valve 3 can therefore be set via the closed-cycled control device 36 so as to obtain an optimum control of the drive 1 for the specific case of use.

We claim:

1. A device for controlling a hydrostatic drive comprising a resonator having a periodically actuatable switch valve which connects the resonator alternately with a pressurized-fluid supply line a return line and the hydrostatic drive, wherein the resonator (2) has at least one pressure chamber (6) with a movable, oscillatable chamber limitation (7) for changing the chamber volume; the movable chamber limitation (7) forms a part of a single-mass oscillator comprising mass and spring (10), and the pressure chamber (6) which is connectable alternately to the pressurized-fluid supply line (4), the return line (5), and the hydrostatic drive (1) via the switch valve (3) with a switch frequency which lies within the supraresonance region of the single-mass oscillator.

2. A device according to claim 1, wherein the switch frequency of the switch valve (3) is adjustable.

3. A device according to claim 2, wherein an open time ($t_D$) of the switch valve (3) for the connection of the pressure chamber (6) to the pressurized-fluid supply line (4) is adjustable.

4. A device according to claim 2, wherein an open time ($t_D$) of the switch valve (3) for the connection of the pressure chamber (6) to the hydrostatic drive (1) is adjustable.

5. A device according to claim 1, wherein the connecting line (12) between the pressure chamber (6) and the hydrostatic drive (1) is connected to a pressure accumulator (13).

6. A device according to claim 1, wherein the pressure chamber (6) of the resonator (2) is formed as a cylinder (8), a piston (9) forms the movable chamber limitation (7) forming the single-mass oscillator having at least one said spring (10) acting on the piston (9).

7. A device according to claim 6, wherein the resonator (2) is formed as said cylinder (8) divided into two chambers by said piston (9), each of the two pressure chambers (6) are connected via one of two switch valves (3) shifted 180° in phase with respect to their shift periods, each one of said two switch valves being connected to the pressurized-fluid supply line (4), the return line (5) and the hydrostatic drive (1).

8. A device according to claim 1, wherein the movable chamber limitation (7) of the pressure chamber (6) of the resonator (2) comprises a bellows or a membrane (14).

9. A device according to claim 1, wherein the switch valve (3) is formed as a rotary piston valve having a rotary piston (17) which connects the at least one pressure chamber (6) via control ports (21, 22, 23) alternately with connecting chambers (24, 25, 26) connected with the pressurized-fluid supply line (4), the return line (5), and the connecting line (12) for the hydrostatic drive (1).

10. A device according to claim 9, wherein control bodies, which are coaxial to the rotary piston (17), are rotatably displaceable with respect to the pressure chamber (6), said control bodies forming control edges (32, 33, 34) cooperating with the control ports (21, 22, 23) of the rotary piston (17).

11. A device according to claim 1 wherein an open time ($t_D$) of the switch valve (3) for the connection of the pressure chamber (6) to the pressurized-fluid supply line (4) is adjustable.

12. A device according to claim 11, wherein an open time ($t_D$) of the switch valve (3) for the connection of the pressure chamber (6) to the hydrostatic drive (1) is adjustable.

13. A device according to claim 1, wherein an open time ($t_D$) of the switch valve (3) for the connection of the pressure chamber (6) to the hydrostatic drive (1) is adjustable.

14. A device according to claim 1, wherein an open time ($t_D$) of the switch valve (3) for the connection of the pressure chamber (6) to the hydrostatic drive (1) is adjustable.

15. A device according to claim 1, wherein the switch valve (3) is formed as a rotary piston valve having a rotary piston (17) which connects a plurality of the pressure chambers (6) via control ports (21, 22, 23) alternately with connecting chambers (24, 25, 26) connected with the pressurized-fluid supply line (4), the return line (5), and the connecting line (12) for the hydrostatic drive (1).

16. A device according to claim 15, wherein control bodies, which are coaxial to the rotary piston (17), are rotatably displaceable with respect to the plurality of pressure chambers (6) arranged with rotational symmetry to the rotary piston (17), said control bodies forming control edges (32, 33, 34) cooperating with the control ports (21, 22, 23) of the rotary piston (17).

* * * * *